United States Patent [19]

Holcombe

[11] Patent Number: 4,559,429

[45] Date of Patent: Dec. 17, 1985

[54] MICROWAVE COUPLER AND METHOD

[75] Inventor: Cressie E. Holcombe, Farragut, Tenn.

[73] Assignee: The United States of America as represented by the United States Department of Energy, Washington, D.C.

[21] Appl. No.: 676,342

[22] Filed: Nov. 29, 1984

[51] Int. Cl.[4] ..... H05B 6/80

[52] U.S. Cl. ..... 219/10.55 F; 219/10.55 M; 219/10.55 R; 204/157.1 R; 204/157.1 H

[58] Field of Search ..... 219/10.55 R, 10.55 E, 219/10.55 F, 10.55 M, 10.55 D, 10.55 A; 99/451, DIG. 14; 126/390; 426/243, 241, 234; 204/157.1 R, 157.1 H, 157.1 S

[56] References Cited

U.S. PATENT DOCUMENTS 3,816,689 6/1974 Long ..... 219/10.55 R 4,114,011 9/1978 Stubbs ..... 219/10.55 M 4,190,757 2/1980 Turpin et al. ..... 99/451 X 4,266,108 5/1981 Anderson et al. ..... 219/10.55 E

*Primary Examiner*—Philip H. Leung

*Attorney, Agent, or Firm*—Earl L. Larcher; Stephen D. Hamel; Judson R. Hightower

[57] ABSTRACT

The present invention is directed to a microwave coupler for enhancing the heating or metallurgical treatment of materials within a cold-wall, rapidly heated cavity as provided by a microwave furnace. The coupling material of the present invention is an alpha-rhombohedral-boron-derivative-structure material such as boron carbide or boron silicide which can be appropriately positioned as a susceptor within the furnace to heat other material or be in powder particulate form so that composites and structures of boron carbide such as cutting tools, grinding wheels and the like can be rapidly and efficiently formed within microwave furnaces.

6 Claims, No Drawings

MICROWAVE COUPLER AND METHOD

This invention was made as a result of work under contract W-7405-ENG-26 between Union Carbide Corporation, Nuclear Division and the U.S. Department of Energy.

BACKGROUND OF THE INVENTION

The present invention relates generally to a microwave coupler formed from a material with an alpha-rhombohedral-boron-derivative structure for effectively converting microwave energy into heat and more particularly to to a method for heating material in a microwave furnace by employing such a coupler.

Microwave energy has been receiving considerable interest as the heating mechanism for various metallurgical procedures especially those involving materials of high purity. In order for microwave energy to be considered a viable heating process in such procedures, the material being heated should possess microwave coupling properties, or a crucible or other form of susceptor having microwave coupling properties should be appropriately positioned in the microwave flux field to provide the coupling for heating the material undergoing the metallurgical procedure.

It was previously found that uranium oxide provided good coupling properties with microwave energy as reported in the publication "Heating of Uranium Oxides in a Microwave Oven" by Paul A. Haas, American Ceramic Bulletin, Vol. 58, No. 9 (1979). However, due to the potentially adverse reactions between uranium oxide and the materials to be heated in the microwave oven or furnace a selection of a material exhibiting greater inertness toward such reactions is needed.

SUMMARY OF THE INVENTION

The primary aim or objective of the present invention is to provide a material possessing a high degree of microwave coupling ability so as to provide for the effective and rapid heating of contents in cold wall furnaces by microwaves. This objective of providing a microwave coupler for converting microwave energy into heat is achieved with a mass of material having an alpha-rhombohedral-boron-derived structure appropriately disposed to intercept microwave flux emanating from a microwave source. Two boron-derived materials found to have particularly good microwave coupling properties are boron carbide ($B_4C$) and boron silicide ($B_6Si$). In typical applications of the boron-derived microwave couplers such as the $B_4C$ and $B_6Si$ the microwave coupler can be placed in an appropriate position within the microwave flux field to provide a susceptor for heating various metal powders to form composites within the microwave furnace or, if desired, the microwave coupler could be in the form of a crucible or a coating on the crucible so as to heat the material within the crucible to appropriate metallurgical temperatures. Another advantage of the present invention is that the boron carbide could form a constituent of a structure such as a cutting tool or abrasive wheel in which the boron carbide in powder form is bonded in a matrix material (such as the $B_6Si$ or aluminum) having a melting point lower than the boron carbide. In such instances, the microwave energy heats the boron carbide particles and melts the contiguous matrix material for embedding the boron carbide particles in the matrix to form the desired structure or composition.

Other and further objects of the invention will be obvious upon an understanding of the illustrative embodiment and method about to be described or will be indicated in the appended claims, and various advantages not referred to herein will occur to one skilled in the art upon employment of the invention in practice.

DETAILED DESCRIPTION OF THE PRESENT INVENTION

In determining the coupling ability of boron carbide a microwave furnace having top and bottom sources, 1600 watts of power and a frequency of 2450 Mhz was utilized. Such a furnace is commercially available as the Radar Line Model QMP 2101-1, Raytheon Co., Lexington, Mass.

Powdered samples of graphite, yttria, alumina, silica, zirconia, boron nitride and boron carbide were initially tested in a microwave coupling experiment. Boron carbide, which has an alpha-rhombohedral-derivative structure, was the only one from this group of materials that coupled with microwave energy. The boron carbide coupling material, as pointed out above, may be in the form of a coating on a suitable ceramic surface such as a crucible or other susceptor configuration in particulate form used in the formation of various compositions or structures within the microwave furnace. The determination of the coupling ability of boron carbide was evaluated by a comparison with other known coupling materials such as the uranium oxide and water. Also, powders of structurally similar materials such as boron suboxide, amorphous boron, boron silicide and boron phosphide were included in this evaluation of boron carbide. Various quantities of these selected materials were placed in 50 mL beakers and covered with a thermal insulation of alumina-silica felt. Also, a plate of boron carbide was evaluated. The covered beakers were then positioned individually in an appropriate position within the aforementioned microwave furnace so as to be subjected to the microwave flux emanating from the top and bottom microwave sources. The covered beakers were subjected to the microwave flux for a duration of thirty seconds and at the end of this heating period the temperatures of the materials were measured with a thermocouple which was moved about the powders and along the plate to obtain the highest temperature measurement. A table is set forth below providing these measurements of the microwave coupling ability of the various materials. In this table the energy absorbed in an evaluation of the integral $C_p dT$ over the observed temperature rise. The terms of the integral: $C_p$ is the heat capacity at constant pressure, and dT is the change in temperature (in K). The heat measurement in calories per mole utilized in the table is believed to be a preferred measurement for determining the relative microwave coupling ability of the materials tested, but in some applications the calories per gram or calories per cubic centimeter may be appropriately utilized. In comparing data from this table, the highest absorption data for a given material should be used because the absorption in a microwave furnace cavity is dependent upon the configuration of the material being subjected to the microwave flux. For example, with smaller configurations less microwave flux will be absorbed. Also, the concentration of the microwave energy within a particular furnace cavity utilized may not be uniform throughout the cavity.

TABLE

Microwave Coupling Data Comparisons

| Material | Weight (Approximate Volume* In Parenthesis, $cm^3$) Grams | | Temperature Maximum (K)** | CAL/MOL | ENERGY ABSORBED*** CAL/G | CAL/$cm^3$*** |
|---|---|---|---|---|---|---|
| Water | 30 | (30) | 370 | 1,260 | 70 | 70 |
| | 40 | (40) | 360 | 1,080 | 60 | 60 |
| Boron Carbide, Powder | 8 | (7) | 415 | 1,875 | 35 | 85 |
| | 20 | (18) | 540 | 4,475 | 80 | 200 |
| | 30 | (28) | 560 | 4,920 | 90 | 220 |
| | 60 | (56) | 530 | 4,250 | 75 | 190 |
| Boron Carbide, Dense Plate (~4 mm thick, 2.5 g/$cm^3$) | 8.1 | (3) | 425 | 2,065 | 40 | 95 |
| Boron Suboxide Powder | 10 | (28) | 510 | 3,795 | 45 | 120 |
| Boron ("Amorphous") Powder | 10 | (28) | 325 | 79 | 7 | 18 |
| Urania Powder ($UO_2$) | 33 | (7) | 925 | 11,770 | 45 | 480 |
| | 132 | (28) | 850 | 10,265 | 40 | 415 |
| Boron Phosphide ($B_{13}P_2$) | 20 | (37) | 385 | 1,409 | 7 | 19 |
| Boron Silicide ($B_6Si$) | 20 | (42) | 730 | 9,040 | 95 | 235 |

*Volume represents the degree of filling of the 50 mL beaker; powders were untamped.
**Ambient temperature approximately 300 K.; temperatures rounded to nearest 5 K.
***Data rounded to nearest 5; except for boron and $B_{13}P_2$, rounded to nearest.
****Based on the theoretical material densities.

After heating the materials listed in the table, the data indicates that the calories per mole absorbed by urania is approximately twice as much as that of boron carbide and about 10–20% greater than boron silicide. The boron carbide absorbed about 30% more microwave energy per mole than boron suboxide and about four times as much microwave energy as water while boron silicide absorbed about twice as much energy per mole as the boron carbide. In the column indicating the calories or microwave energy absorbed per cubic centimeter, urania is approximately twice as absorptive as is boron carbide and the boron silicide, while the latter two materials are twice as absorptive as boron suboxide and nearly four times as absorptive as water. However, in the column listing the microwave sorption in calories per gram, boron carbide and boron silicide are shown to be the most efficient microwave coupling materials of the group in that they absorb about 30% more of the microwave energy than water and approximately twice as much microwave energy as the urania or the boron suboxide.

The apparent reason for the coupling ability of boron carbide and boron silicide being greater than structurally similar materials of the boron suboxide ($B_6O$), boron phosphide ($B_{13}P_2$), and the amorphous (alpha) boron is due to the greater degree of lattice distortion which is dependent upon the stoichiometry and a filling of the interstitial positions within the materials. The degree of lattice distortion for boron carbide is also dependent upon the amount of carbon that is substituted for the boron atoms in the icosahedra.

In comparison, the $B_6Si$ has an alpha-rhombohedral-boron-derivative structure that resembles boron carbide ($B_4C$). In this structure, groups of twelve boron atoms arranged at the vertices of an icosahedron are bonded to other similar groups. Also, these groups of twelve boron atoms arranged at the vertices of an icosahedron are bonded to groups of two silicon atoms which take the place of the linear chains of three carbon atoms in $B_4C$. However, the unit cell of $B_6Si$ is orthorombic with a considerably larger unit cell than the rhombohedral cell of the simple alpha-rhombohedral boron derivative structure. Thus, the $B_6Si$ is more complicated in appearance than $B_4C$ yet the structures of $B_4C$ and $B_6Si$ are very similar, at least in the approximation. The silicon atoms can substitute for the boron positions in the icosahedron and the boron atoms can substitute for the silicon in their positions. Consequently, a certain statistical probability is given that the positions in the icosahedron will be constantly filled by either boron or silicon for most of the lattice sites. Accordingly, the $B_6Si$ can be considered a distorted version of $B_4C$ having an alpha-rhombohedral boron structure.

The $B_{13}P_2$ has an alpha-rhombohedral boron derivative structure which has a more ordered and a less distorted lattice structure resulting in a lower level of microwave coupling ability than $B_6Si$. The $B_{13}P_2$ has a microwave coupling ability very similar to amorphous boron on a cal/g and cal/$cm^3$ comparison and almost 25 percent of the microwave coupling ability of $B_4C$ on a cal/mol comparison. Therefore, it appears that since the lattice distortion is greater for boron carbide and boron silicide than other boron materials such as amorphous boron and boron phosphide, the microwave coupling ability of boron carbide and boron silicide are greater since the coupling efficiency or heating ability of these materials follows the same pattern in which the coupling efficiency for microwaves is proportional to the degree of lattice distortion in the molecular structure.

As mentioned above, the materials (alpha-rhombohedral boron or amorphous boron, boron carbide, boron suboxide, boron phosphide and boron silicide are isostructural or have the same structure). Since the microwave absorption of these materials appear to be characteristic of this structure type, some further description of the structure is necessary. There exists an isotypic series of materials which have a crystal structure based on (or derived from) alpha-rhombohedral boron (or alpha-boron); these materials are called alpha-rhombohedral boron derivatives, derivative structures of alpha-boron. They have been labelled "compounds", "interstitial solid solutions", or "ordered solid solutions". Because the boron carbide structure historically was solved before that of alpha-rhombohedral boron, these materials are also sometimes referred to as "boron carbide derivatives" or "$B_4C$" derivatives or analogs.

The alpha-boron structure contains an icosahedra of boron atoms placed at the vertices of the unit cell. There are three "holes" lying on the three-fold axis of the rhombohedral unit, forming a linear chain of "holes". The central "hole" is not crystallographically identical to the other two "holes". In fact, if the central "hole" only were to be filled, the distribution is nearly equivalent (though somewhat distorted) to the sodium chloride structure, whereby the center of the boron icosahedra is equivalent to the sodium ion and the central "hole"-filling atom is equivalent to the chloride ion. Given this structure, the typical formulae of derivative structures would be derived from the following general formula:

$B_{12}YXY$ or $B_{12}XY_{12}$

Where B represents the boron atoms comprising the icosahedra, and X represents the central "hole" lying on the three-fold axis of the rhombohedral unit, and Y represents the other two "holes" lying equidistant (on either side) from the central X "hole".

Therefore, alpha-rhombohedral boron is the material formed when the interstitial positions Y and X are filled with metalloids or nonmetals from Groups III A, IV A, V A, or VI A of the Periodic Table of the Elements: i.e., B, Al, C, Si, N, P, $A_s$, O, S. Typical of the reported formulae for the "compounds" are

| | |
|---|---|
| $B_{12}C_3$ (or $B_4C$) | both X and Y positions filled with carbon |
| $B_{13}C_2$ | X position filled with boron |
| | X position filled with carbon |
| $B_{12}Si_3$ (or $B_4Si$) | both X and Y positions filled with silicon |
| $B_{13}Si_2$ | X position filled with boron |
| | Y position filled with silicon |
| $B_{12}O_2$ (or $B_6O$) | X position vacant |
| | Y position filled with oxygen |
| $B_{13}O_2$ | X position filled with boron |
| | Y position filled with oxygen |
| $B_{13}P_2$ | X position filled with boron |
| | Y position filled with phosphorus |
| $B_{13}As_2$ | X position filled with boron |
| | Y position filled with arsenic |
| $B_{12}S$ | X position filled with sulfur |
| | Y position vacant |

Ternary interstitial alpha-rhombohedral boron derivatives also have been indicated:

| | |
|---|---|
| $B_{12}C_2S$ | X position filled with sulfur |
| | Y position filled with carbon |
| $B_{12}O_2Si$ | X position filled with silicon |
| | Y position filled with oxygen |
| $B_{12}C_2Al_{0.25-0.75}$ | X position filled (statistically) with aluminum |
| | Y position filled with carbon |

It has been observed generally that the X position can be readily filled with carbon, silicon, arsenic, or phosphorus, or remain vacant; whereas, the Y positions can be readily filled with boron, carbon, silicon or sulfur or remain vacant. And, it would be obvious that multi-element combinations could occur.

In addition to the interstitial filling referred to in the formula $B_{12}XY_2$ where the interstitial positions X and/or Y are partially or completely filled, there is the possible (and reported, in some cases) substitution of some of the icosahedral boron atoms (those in the $B_{12}$ unit) with other atoms such as oxygen, silicon or carbon. The compound, $SiB_{2.82}$ or $Si_{11}B_{31}$, reportedly occurs from this type of substitution within the alpha-rhombohedral boron structure type.

There is indication that some level of interstitial and/or substitutional derivative structures of alpha-rhombohedral boron are considered, the metalloids or nonmetals from Groups III A, IV A, V A, or VI A and atoms from the first, second and third rows of the Periodic Table as well as vacant lattice sites, it is obvious that a large number of possibilities exist while retaining the same structural type—or each element can exist with other elements or vacancies, yielding homogeneity ranges that are quite wide. Thus, these structural derivatives of alpha-rhombohedral boron can all be considered as ordered solid solutions. With the filling, partial or complete, of interstitial or substitutional (in the boron icosahedra) lattice sites, almost any "formula" can be derived using the stated elements. All will, of course, have a high boron content, with 73.8 at. % boron being the lowest-boron-content, alpha-boron derivative structure reported (for $SiB_{2.82}$). The lattice distortion should be quite variable depending on the degree and type of interstitial and/or substitutional solid solution in the alpha-rhombohedral boron structure. Since all three representative alpha-boron isotypic materials ("amorphous" boron, boron carbide and boron suboxide) coupled with microwave energy, it is expected that all alpha-rhombohedral-boron-derivative structures will exhibit similar behavior with the coupling efficiency expected to increase as the lattice distortion increases—which occurred for the three materials investigated.

In order to provide a more facile understanding of the present invention an Example set forth below demonstrates the coupling ability of boron carbide.

EXAMPLE

In this example a sheet of aluminum metal was placed between two sheets of boron carbide. The boron carbide sheets were 3.0 cm in length, 1.5 cm in width and 0.4 cm in thickness. The aluminum metal disposed between the sheets was a pellet of the dimensions 10 mm in diameter by 3 mm in thickness. The laminated arrangement of the aluminum and boron carbide sheets was then wrapped in a thermal insulation formed of alumina-silica felt and placed in the cavity of the microwave furnace described above. The contents of the furnace was then subjected to the complete flux of microwaves emanating from the top and bottom sources of the oven for a duration of 11.4 minutes. The door of the microwave furnace was then immediately opened and the top portion of the thermal insulation partially lifted for observation. The boron carbide sheets were red hot and the aluminum was molten between the sheets of boron carbide. By pressing the boron carbide sheets together the molten aluminum was forced to flow from between the sheets leaving only a thin layer of molten aluminum between the boron carbide sheets. Upon cooling, the boron carbide sheets were removed from the microwave furnace and a visual examination indicated that the boron sheets were tightly bonded together by a thin layer of aluminum.

The example was conducted in an air atmosphere which permitted limited oxidation of the boron carbide sheets but it will be clear that an inert atmosphere could be utilized in the furnace to eliminate oxidation problems associated with the various metals utilized in metallurgical procedures or the oxidation of the boron carbide coupler.

It will be seen that the present invention provides a microwave coupler which will considerably improve the use of microwave systems for metallurgically processing material in a cold-wall, rapidly heated furnace. Another advantage afforded by the present invention is that in applications where boron carbide is utilized as a constituent of a composition or a product such as in the formation of cutting tools and grind wheels, the unique coupling ability of the boron carbide provides for efficient fabrication in microwave systems. Additionally, since graphite does not couple with microwaves, graphite crucible/mold combinations and graphite insulation could be used in inert or vacuum atmospheres to allow complete melting and casting of boron carbide components.

I claim:

1. A microwave coupler in combination with a microwave energy source for converting microwave energy emanating from said source into heat, said microwave coupler consisting of a material having an alpha-rhombohedral-boron-derivative structure in which the boron content is greater than about 73 atomic percent and with said material being disposed to intercept microwave energy from said source.

2. A microwave coupler as claimed in claim 1 wherein the material is boron carbide or boron silicide.

3. A method for converting microwave energy into heat for heating material within a microwave furnace, comprising the step of positioning at least one mass of material having an alpha-rhombohedral-boron-derivative structure in which the boron content is greater than about 73 atomic percent within the furnace to intercept microwave flux emanating from a microwave source.

4. The method claimed in claim 3 wherein the mass of material is boron carbide or boron silicide.

5. The method claimed in claim 4 wherein the boron carbide or boron silicide at least partially forms a crucible, and wherein the material being heated within the microwave furnace is disposed in said crucible.

6. The method claimed in claim 3 wherein the mass of material is boron carbide and wherein the material being heated in said furnace is a composition comprising boron carbide particulates and a matrix-forming metal or metal compound in particulate form having a melting point lower than boron carbide.

* * * * *